US005291880A

United States Patent [19]

Almovist et al.

[11] Patent Number: 5,291,880

[45] Date of Patent: Mar. 8, 1994

[54] PROTECTIVE HELMET WITH PROTECTIVE FACEPIECE CONNECTION AND ADJUSTMENT PROVISION

[75] Inventors: Hans O. Almovist; Bengt Kjellberg, both of Branford, Conn.; Benjamin Huey, West Chester, Pa.; Raymond E. Stevens, Jr., Greenville, Del.; Ian Drummond, Victoria, Australia

[73] Assignee: Cairns & Brother Inc., Clifton, N.J.

[21] Appl. No.: 731,315

[22] Filed: Jul. 19, 1991

Related U.S. Application Data

[63] Continuation-in-part of Ser. No. 568,420, Aug. 16, 1990, abandoned.

[51] Int. Cl.[5] ..... A62B 17/04

[52] U.S. Cl. ..... 128/201.22; 128/201.24; 128/206.24

[58] Field of Search ..... 128/206.24, 206.27, 128/207.11, 201.22, 201.24; 2/411, 414, 424, 425

[56] References Cited

U.S. PATENT DOCUMENTS

| | | | |
|---|---|---|---|
| 2,882,896 | 4/1959 | Seeler | 128/201.24 |
| 2,918,060 | 12/1959 | Lobelle | 128/201.24 |
| 3,167,069 | 1/1965 | Lobelle | 128/201.24 |
| 3,223,086 | 12/1965 | Denton | 128/201.24 |
| 3,293,659 | 12/1966 | Shepard | 128/201.24 |
| 3,373,444 | 3/1968 | Militello | 2/424 |
| 3,822,698 | 7/1974 | Guy | 2/424 |
| 3,910,269 | 10/1975 | Ansite et al. | 128/201.24 |
| 4,020,507 | 5/1977 | Morton | 2/411 |
| 4,083,065 | 4/1978 | Warncke | 2/424 |
| 4,136,403 | 1/1979 | Walter et al. | 2/6 |
| 4,136,688 | 1/1979 | Gorman | 128/206.24 |
| 4,286,339 | 9/1981 | Coombs | 2/414 |
| 4,315,335 | 2/1982 | Kennedy, Jr. et al. | 128/206.24 |
| 4,549,542 | 10/1985 | Chien | 128/201.24 |
| 4,555,815 | 12/1985 | Walther | 2/424 |
| 4,734,940 | 4/1988 | Galet et al. | 2/422 |
| 4,817,596 | 4/1989 | Gallet | 128/201.24 |
| 5,078,130 | 1/1992 | Van Oosten et al. | 128/201.24 |
| 5,119,516 | 6/1992 | Broersma | 2/411 |

*Primary Examiner*—Edgar S. Burr
*Assistant Examiner*—Aaron J. Lewis
*Attorney, Agent, or Firm*—R. Gale Rhodes, Jr.

[57] ABSTRACT

In combination, a protective helmet including an outer shell and an inner impact shell, a protective facepiece, and interconnecting members for mounting the facepiece to the inner impact shell and for placing the facepiece into sealing engagement with the face of a wearer of the helmet.

12 Claims, 9 Drawing Sheets

FIG. 8
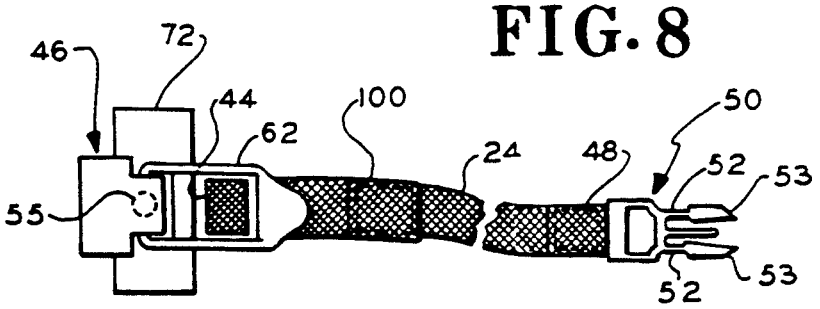
FIG. 7
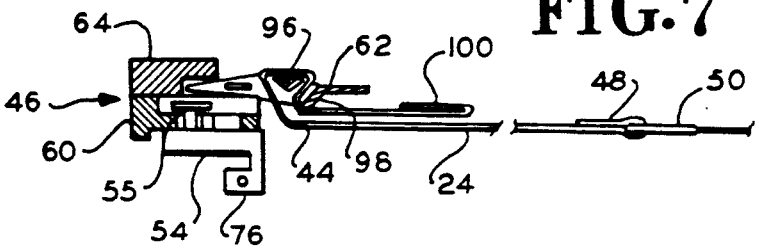
FIG. 10
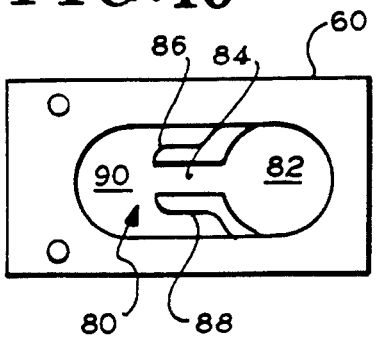
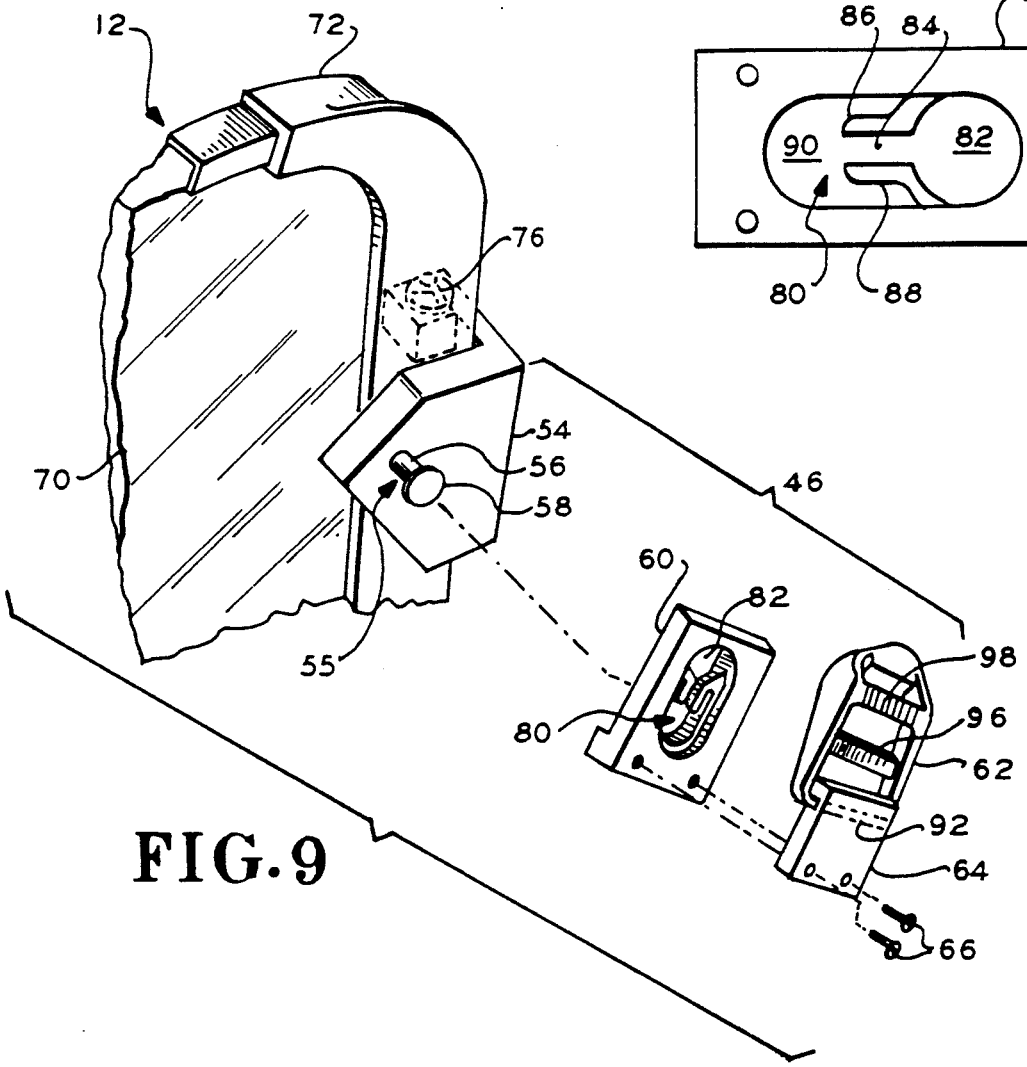
FIG. 9

PROTECTIVE HELMET WITH PROTECTIVE FACEPIECE CONNECTION AND ADJUSTMENT PROVISION

CROSS-REFERENCE TO RELATED APPLICATIONS

This application is a continuation-in-part application of U.S. Patent Application Ser. No. 568,420, filed on Aug. 16, 1990, now abandoned, in the names of Hans O. Almqvist, Bengt Kjellberg and Benjamin Huey and assigned to the same assignee as this application

BACKGROUND OF THE INVENTION

This invention relates generally to a protective helmet with protective facepiece connection and adjustment provision, and more particularly relates to a protective helmet including an outer shell and an inner impact shell and mounting means for mounting a protective facepiece to the inner impact shell and which mounting means includes adjustment means for adjusting the force with which the protective mask is forced into sealing engagement with the face of a wearer of the helmet.

Numerous protective helmets with protective facepiece connection and adjustment provision are known to the prior art, such as for example those disclosed in U.S. Pat. Nos. 4,083,065; 4,136,403; 4,555,815; 4,734,940; and 4,817,596; it will be noted that none of these patents disclose connection of a protective facepiece to the inner impact shell of a protective helmet.

Protective helmets, such as those used by firefighters or the like, are also known to the art which include a relatively rigid outer shell and a deformable inner shell, sometimes referred to in the art as an inner impact shell, wherein the inner impact shell deforms upon receipt of an impact force on the helmet, such as that caused by a falling object, and which deforms to assist, in combination with the outer relatively hard shell and in some embodiments additional structure, in attenuating the impact force to protect the head of the wearer of the helmet. An example of such protective helmet is disclosed in U.S. Pat. No. 4,286,339, patented Sep. 1, 1981, Peter A. Coombs inventor, entitled FIREMAN'S HELMET WITH ENERGY ABSORBING LINER, and assigned to the same assignee as the present invention (hereinafter "Coombs Patent"); the Coombs Patent is hereby incorporated herein by reference as if fully set forth herein. The Coombs Patent discloses, note FIG. 2, an outer shell 10 of relatively hard material such as polycarbonate and a separate non-resilient foam (e.g. polyurethane) liner 20, better understood by reference to FIG. 3 of the Coombs Patent, which non-resilient foam liner 20 is is mounted removably to the interior of the outer shell and which is deformable under an impact force such as that provided by a falling object to attenuate the force and assist other helmet structure, as taught in the Coombs patent, in providing protection to the head of the wearer of the helmet. Such non-resilient foam liner 12 of the Coombs patent is sometimes referred to in the art as an inner impact cap or shell or a deformable impact cap or shell and will be so referred to in the following specification and appended claims. As further taught in the Coombs Patent and shown particularly in FIGS. 2 and 3, a cradle 30 comprised of a plurality of radially disposed straps 32 of strong webbing, such as nylon, are stitched together at the central apex of the cradle, and each strap extends from the apex to the lower rim 22 of the inner impact shell 20 at a notch 23 formed in the rim 22. The straps 32 wrap about the rim 22 and proceed upwardly along the outer surface of the inner impact shell 20, wrap about a relatively thick walled, fairly rigid tube 25 of resilient plastic, such as polyethylene, which tube 25 is inset in a groove formed in the lower outer surface of the inner impact shell 20, and then proceed back along the lower rim 22 of the inner impact shell to approach the apex as a free end with a loop 33; the loops 33 of the free ends of the straps are collected by a draw string 35 which is mounted to allow adjustment of the cradle 30 to suit the head of an individual wearer of the helmet.

As known to those skilled in the art, an advantage provided by a protective helmet including a hard outer shell and a deformable inner impact cap or shell mounted removably to the interior of the outer shell of the type disclosed in the Coombs Patent is that upon a fireman having such helmet strapped tightly to his head and falling through a hole typically present at the scene of the fire, the fireman will not suffer injury, e.g. strangulation, upon falling through the hole and having the brim of his protective helmet catch on structure on either side of the hole; instead only the outer shell will be caught by the structure on either side of the hole and the inner impact shell, with the fireman's head strapped inside, will separate from the outer shell and pass through the hole and prevent the fireman from hanging and possibly strangling.

As noted above, none of the United States patents identified above in the second paragraph hereof teach or suggest the connection of a protective facepiece to the inner impact shell of a protective helmet including both the inner impact shell and an outer shell as described above. Accordingly, there exists a need in the art for the combination of a protective helmet including an outer shell and a deformable inner impact cap or shell mounted removably to the interior of the outer shell and a protective facepiece wherein the facepiece is connected or mounted to the inner impact cap or shell shell whereby at a time of need for the protective facepiece such as at the scene of a fire, the facepiece remains in sealing engagement with the face of the fireman even when the outer shell of the fireman's protective helmet becomes disassociated with the inner impact shell. A further need in the art is for such combined structure wherein the facepiece is mounted or connected adjustably to the inner impact shell whereby the force with which the facepiece is forced into sealing engagement with the face of the wearer of the helmet may be adjusted.

SUMMARY OF THE INVENTION

It is the object of the present invention to satisfy the foregoing needs in the art and apparatus embodying the present invention may include, in combination, a protective helmet including an outer shell and an inner shell, a protective facepiece, and interconnecting members for mounting the facepiece to the inner impact shell and for placing the facepiece into sealing engagement with the face of a wearer of the helmet.

DESCRIPTION OF THE DRAWINGS

FIG. 1 shows the embodiment of the present invention in the standby position, and FIG. 2 shows such embodiment in the use or user position;

FIG. 7 is a side view of an interconnecting member included in the present invention for mounting or connecting, in combination with the mounting member of FIGS. 4–6, the protective facepiece to the inner impact shell of the protective helmet of the present invention;

FIG. 8 is a top or plan view of the member shown in FIG. 7;

FIG. 9 is an exploded view, in perspective, of the mounting member of the present invention for connecting one end of the interconnecting member shown in FIGS. 7 and 8 to one side of the protective facepiece of the present invention;

FIG. 10 is a top or plan view of a keyed connector plate included in the mounting member shown in FIG. 9;

DESCRIPTION OF THE PREFERRED EMBODIMENT

Figure 1:
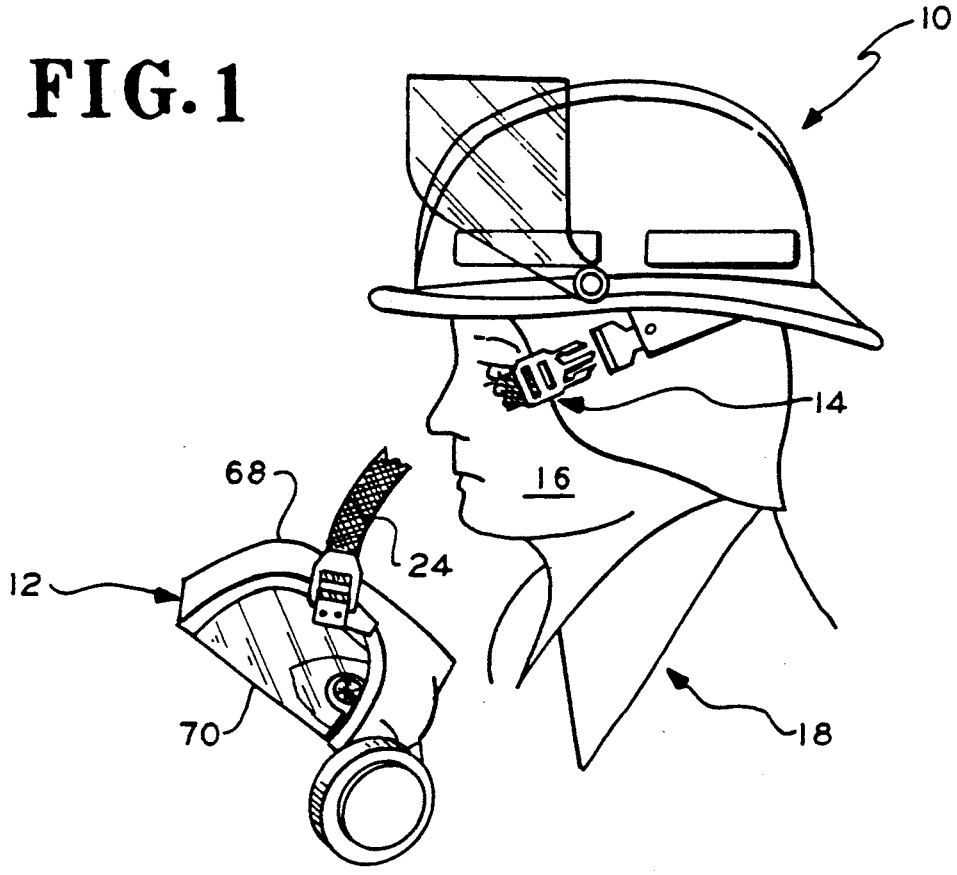
FIGS. 1 and 2 are partial left side views of a wearer, for example a fireman, of an embodiment of the present invention including in combination a protective helmet, protective facepiece and mounting apparatus for mounting the facepiece to the impact shell of the helmet (not shown in FIGS. 1 and 2) and for placing or forcing the facepiece into sealing engagement with the face of the helmet wearer.
Figure 2:
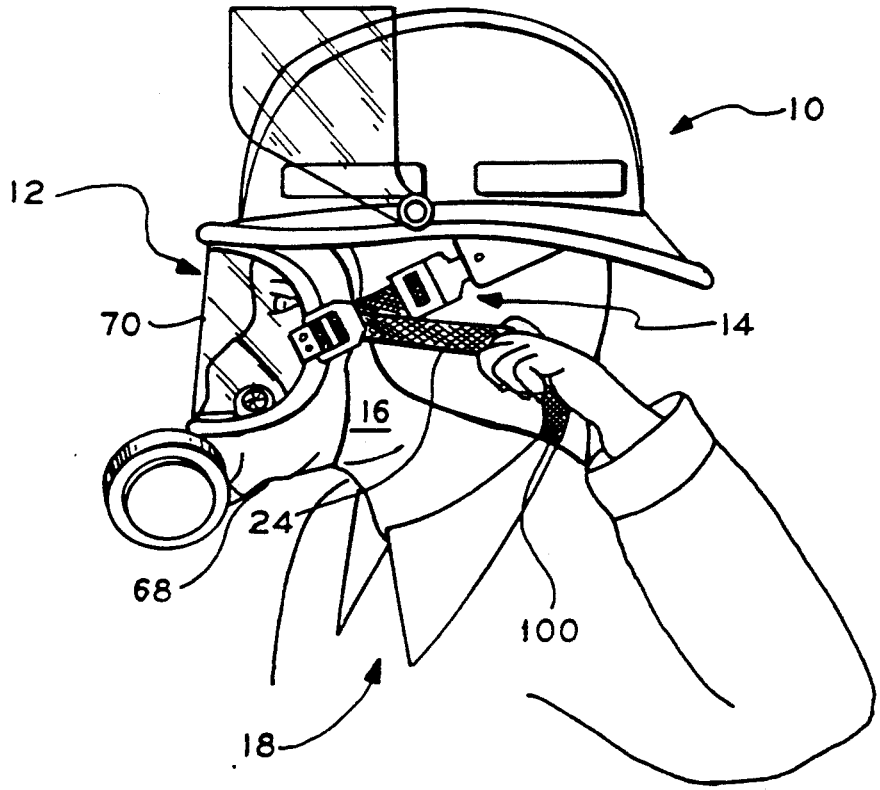
Figure 3:
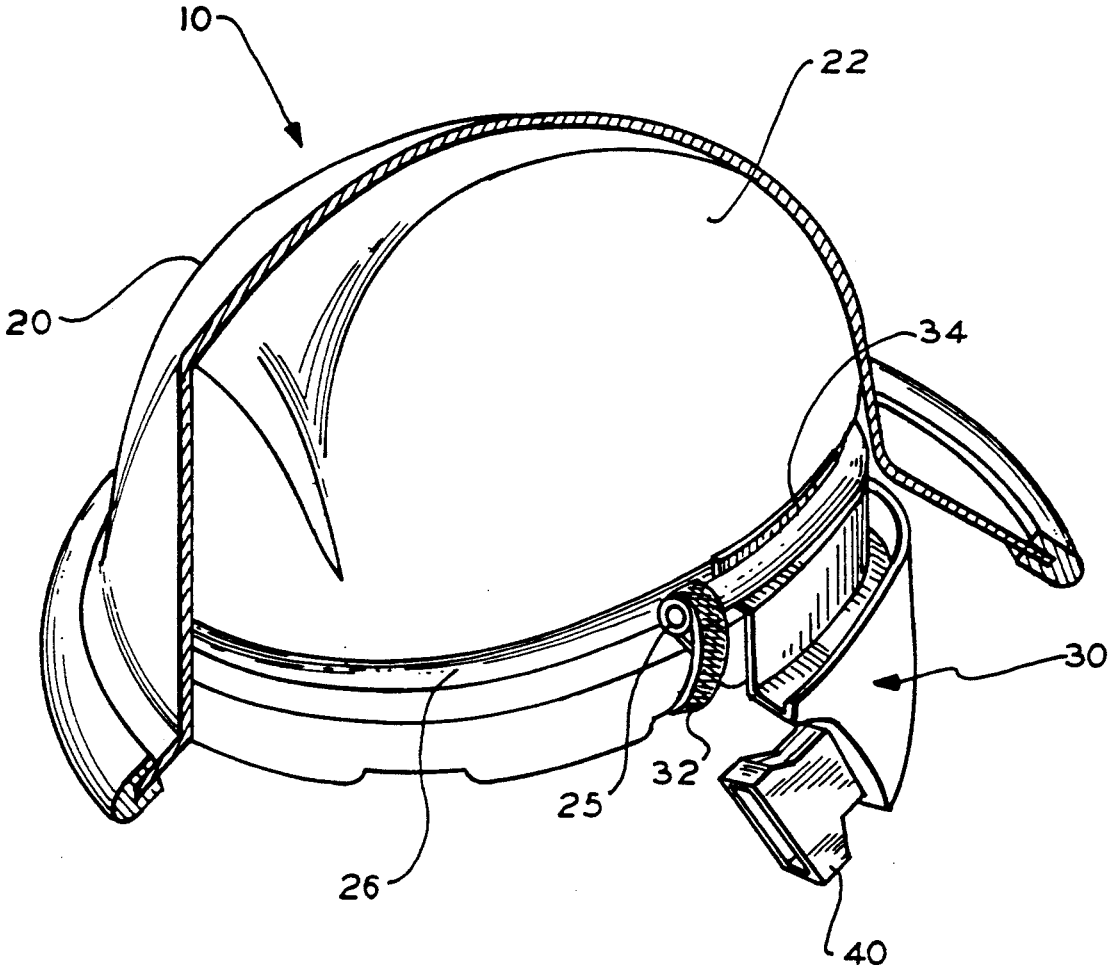
FIG. 3 is a perspective view of an embodiment of the present invention with a portion of the outer shell of the protective helmet being broken away and with the figure illustrating the mounting of a mounting member of the present invention to the inner impact shell.

Referring now to the drawings, in particular FIGS. 1, 2 and 3, there is shown an embodiment of the present invention including, in combination, a protective helmet indicated by general numerical designation 10, a protective facepiece indicated by general numerical designation 12, and a mounting member indicated by general numerical designation 14 for mounting the facepiece 12 to an inner impact shell 22 (note FIG. 3) included in the helmet 10 and for placing or forcing the facepiece 12 into sealing engagement with the face 16 of the wearer of the helmet 10 which helmet wearer is indicated by general numerical designation 18 in FIGS. 1 and 2; more particularly the mounting member 14 is for mounting the facepiece 12 removably to the inner impact cap or shell 22. (Although not shown in FIGS. 1 and 2, it will be understood that a second mounting member 14 is included in the present invention and located on the opposite sides of the facepiece 12 and helmet 10). In this embodiment, the protective helmet 10 is embodied as a firefighter helmet of the type disclosed in the above-identified Coombs Patent and including, as shown in detail in FIG. 3, a relatively hard outer shell 20 and a deformable inner impact cap or shell 22 mounted removably to the interior of the outer shell as taught in the Coombs patent. In FIG. 1, the facepiece 12 is shown in the standby position and in FIG. 2 the facepiece is shown in the use or user position with the facepiece being moved or drawn into the user position shown in FIG. 2 by the helmet wearer 18 pulling the free end of a flexible strap 24 included in the mounting apparatus 14 to adjust the force with which the facepiece 12 is forced or placed into sealing engagement with the face 16 (FIG. 1) of the helmet wearer 18 as will be described in detail below. It will be generally understood that the mounting member 14 (FIGS. 1 and 2) includes the flexible strap 24 provided on either end with mounting members 46 and 50 (FIGS. 7 and 8) and the generally semi-annular mounting member 30 (FIGS. 3–6) provided with mounting member 40 (FIGS. 3, 4 and 6).

Referring now to FIG. 3, it will be recalled, as described above with regard to the description of the protective helmet disclosed in the Coombs Patent, that the lower outer portion of the inner impact shell 22 is provided with an annular groove 26 for receiving the resilient annular tube 25 which mounts a cradle of straps (only strap 32 of such cradle being shown in FIG. 3), interiorly of the inner impact shell 22 for engagement by the head of the helmet wearer. A portion of a generally semi-annular mounting member indicated by general numerical designation 30 is shown in FIG. 3 and it will be generally understood that the generally semi-annular mounting member 30 is provided with a plurality of upwardly extending portions or tabs 34, only one such upwardly extending portion or tab 34 being shown in FIG. 3, for removably mounting the semi-annular mounting member 30 to, and generally underlying, the rearward generally semi-annular portion of the inner impact shell 22 by wedging the upwardly extending portion or tabs 34 between the resilient annular tube 25 and the inner impact shell 22. It will be further understood that the generally semi-annular mounting member 30 and the generally semi-annular rearward portion of the impact shell 22 are generally complementary in shape or configuration.

Figure 4:
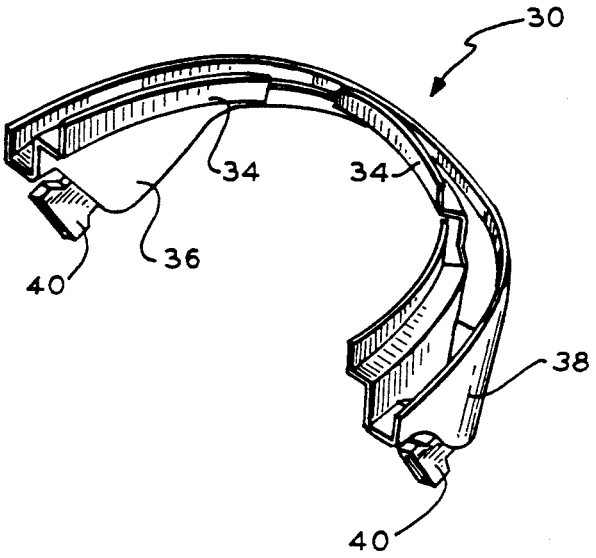
FIG. 4 is a perspective view of the mounting member of the present invention which is mounted to the inner impact shell.
Figure 5:
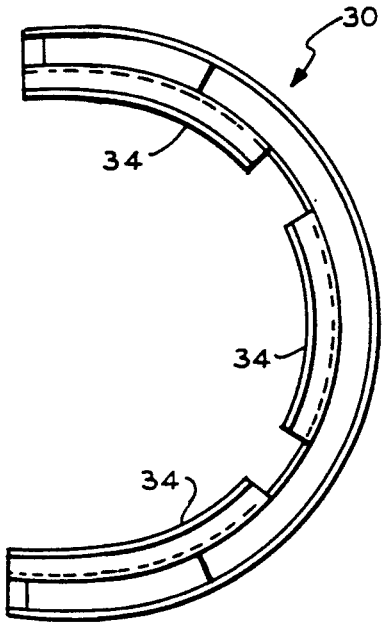
FIGS. 5 and 6 are, respectively, side and top plan views of the mounting member shown in perspective in FIG. 4.
Figure 6:
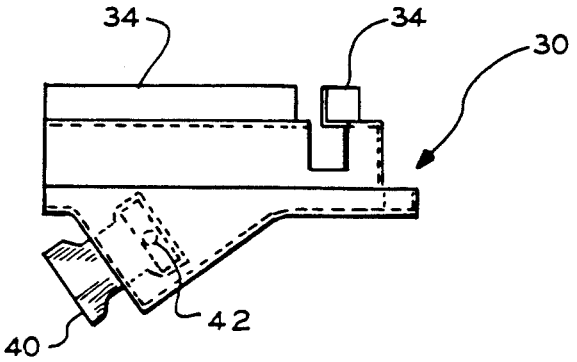

Referring now to FIGS. 4–6, and more particularly to the generally semi-annular mounting member 30, this mounting member 30 is provided with a plurality of upwardly extending portions or tabs 34 for being wedged between the annular resilient member 25 and inner impact shell 22 (FIG. 3) to removably mount the generally semi-annular mounting member 30 to the inner impact shell as noted above. The generally semi-annular mounting member 30 is provided with a pair of forward portions 36 and 38 each of which is provided with a mounting member 40 mounted pivotally to the forward portions of the mounting member 30 as illustrated by the pin 42 shown in dashed outline in FIG. 6.

It will be understood that the mounting members 40 may each be, for example, the receptacle member 16 shown and described in U.S. Pat. No. 4,150,464, patented Apr. 24, 1979, Richard J. Tracey inventor, entitled BUCKLE, assigned to the Illinois Tool Works, Inc., Chicago, Illinois, and which patent is hereby incorporated herein by reference as if fully reproduced herein and which patent will be referred to hereinafter as the Tracey Patent. The receptacle member 16 of the Tracey Patent, FIG. 2 thereof, is provided with a pair of slots 30 and 32 for receiving tabs 38 and 40 provided at the ends of resilient arms 34 and 36 provided on the clasp member 18 to interconnect and releasably engage the receptacle member 16 and clasp member 18. It will be understood that the mounting members 40, FIGS. 3, 4 and 6 hereof, although not shown, include the tab receiving slots noted with regard to the receptacle 16 of the Tracey Patent.

A better understanding of the flexible strap 24 and the mounting members provided on either end thereof may be obtained by reference to FIGS. 7–9 where the detailed structures of such flexible strap and mounting members are shown. The forward portion 44 of the flexible strap 24 is provided with a mounting member indicated by general numerical designation 46 and the rearward portion 48 of the flexible strap 24 is provided with a mounting member indicated by general numerical designation 50; the mounting member 50 may be, for example, the clasp member 18 referred to above disclosed in the above-identified Tracey Patent and, accordingly, may include a pair of resilient arms 52 provided with a pair of tabs 53 at the ends thereof as shown in FIG. 8 for releasably engaging the pair of slots formed in the mounting members 40, as described above to interconnect the mounting members 40 and 50.

The detailed structure of the mounting member 46 provided on the forward portion of the strap 24 may be better understood by reference to FIG. 9 wherein the mounting member 46 is shown to include a clamping bracket 54 provided with an outwardly extending headed connecting pin 55 including a shank 56 provided at the end thereof with an enlarged head 58, a keyed connector plate 60, a buckle 62, a clamping plate 64, and a pair of screws or fastening means 66. An enlargement of a portion of the protective facepiece or facemask 12 (FIGS. 1 and 2) is shown in FIG. 9, and it will be understood that the protective facepiece 12 may, as known to those skilled in the art, include an outer body 68 (shown in FIGS. 1 and 2 but not shown in FIG. 9) of flexible material, e.g. a suitable plastic or rubber, sometimes referred to as a flexible skirt, and a transparent lens 70 mounted to the flexible body or skirt 68 by a lens clamping ring 72, sometimes referred to as a lens bezel. It will be understood, and as known to those skilled, that the clamping ring 72 is split to permit ready insertion of the transparent lens 70 into the clamping ring and it will be understood, from FIG. 9, that the clamping bracket 54 is mounted to the lens clamping ring 72 by suitable clamping means 76 shown in dashed outline in FIG. 9. The keyed connector plate 60, FIGS. 9 and 10, is made of flexible material, e.g. a suitable plastic, and is provided with a keyway indicated by general numerical designation 80. The keyway includes a first open portion 82 sufficiently large to permit the insertion therethrough of the enlarged head 58 of the pin 55, a channel portion 84 defined by two opposed flexible members 86 and 88 spaced apart a sufficient distance to permit the forced passage therethrough of the shank 56 of the pin 55, and a second open portion 90 smaller than the enlarged head 58 of the pin 55 and for capturing the head upon the connecting pin shank 56 being forced through the channel portion 84 to removably mount the keyed connector plate 60 to the clamping bracket 54.

It will be understood that the buckle 62 may be, for example, the buckle 10 disclosed in U.S. Pat. No. 4,171,555 patented Oct. 23, 1979, John A. Baker et al. inventors, entitled BUCKLE, assigned to the Illinois Tool Works, Inc., which patent is hereby incorporated herein by reference as if fully set forth herein and which patent is referred to hereinafter as the Baker Patent. The buckle 62, FIG. 9 hereof, includes a rearward transverse member 92, shown in dashed outline, and it will be understood that the clamping plate 64 includes a groove, not shown, for receiving the rearward transverse member 92 of the buckle 62 to mount the buckle to the keyed connector plate 60 upon the threaded fasteners or screws 66 being inserted through the holes shown in the rearward portion of the clamping plate 66 and screwed into the threaded slots shown in the rearward portion of the keyed connector plate 60.

Referring again to the buckle 62 and flexible strap, FIGS. 7, 8 and 9, it will be understood that the forward portion 62 (FIGS. 7 and 8) of the flexible strap 24 extends between a pair of transverse bars 96 and 98, FIGS. 8 and 9, and wraps around the transverse bar 96 as shown in FIG. 8. (The transverse bars 96 and 98 shown in FIGS. 8 and 9 hereof are equivalent to the transverse bars 50 and 70 shown in FIG. 5 of the Baker Patent.) It will be understood, and as taught in the Baker Patent with regard to the strap or webbing 22 having a free end 26, that upon the free end 100 of the forward portion of the flexible strap 24 being pulled toward the face of the helmet wearer 18, FIG. 2, the effective length of the flexible strap 24 is decreased to draw or move the protective facepiece 12 towards the face 16 of the helmet wearer 18 and to place or force the flexible skirt 68 of the protective facepiece 12 into sealing engagement with the face 16 of the helmet wearer 18 as shown in FIG. 2. It will be further understood, and as further taught in the Baker Patent, that the force with which the facepiece 12 is forced or placed into sealing engagement with the face 16 of helmet wearer 18 is adjustable and determined by the amount of force with which the free end 100 of the flexible strap 24 is drawn toward the face 16 of the helmet wearer 18. As still further disclosed in the Baker Patent, upon the free end 100 of the forward portion of the flexible strap 24 being drawn with different forces toward the face 16 of the helmet wearer 18, the forward portion 62 of the flexible strap 24 is trapped at different positions between the transverse bars 96 and 98 (FIGS. 7–9) to maintain the flexible skirt 68 of the protective facepiece 12 in sealing engagement with the face of the helmet wearer with different forces whereby the force with which the flexible skirt 68 is placed into sealing engagement with the face 16 of the helmet wearer 18 is adjustable.

In brief review and referring primarily to FIGS. 1–3, it will be understood that the preferred embodiment of the present invention includes, in combination, a protective helmet 10 including a rigid or hard outer shell 20 and a deformable inner impact cap or shell mounted removably to the interior of the outer shell, a facepiece 12, and a pair of mounting members or apparatus 14 for removably mounting the facepiece 12 to the deformable inner impact cap or shell 22 (FIG. 3) of the helmet 10. Adjustment of the force with which the facepiece 12 is forced or placed into sealing engagement with the face 16 of the helmet wearer 18, FIG. 2, is provided by the flexible strap 12 and buckle 62 shown particularly in FIGS. 7, 8 and 9. The forward ends of the flexible straps 24 are removably connected to the facepiece 12 by the mounting members 46, FIGS. 1, 2 and 7 9, and the rearward portions of the flexible straps 24 are removably connected to the generally semi-annular mounting member 30 by interconnections of the mounting members 50 provided on the rearward portions of the flexible straps 24 and the mounting members 40 provided on the forward portions 36 and 38 of the generally semi-annular mounting member 30.

Figure 11:
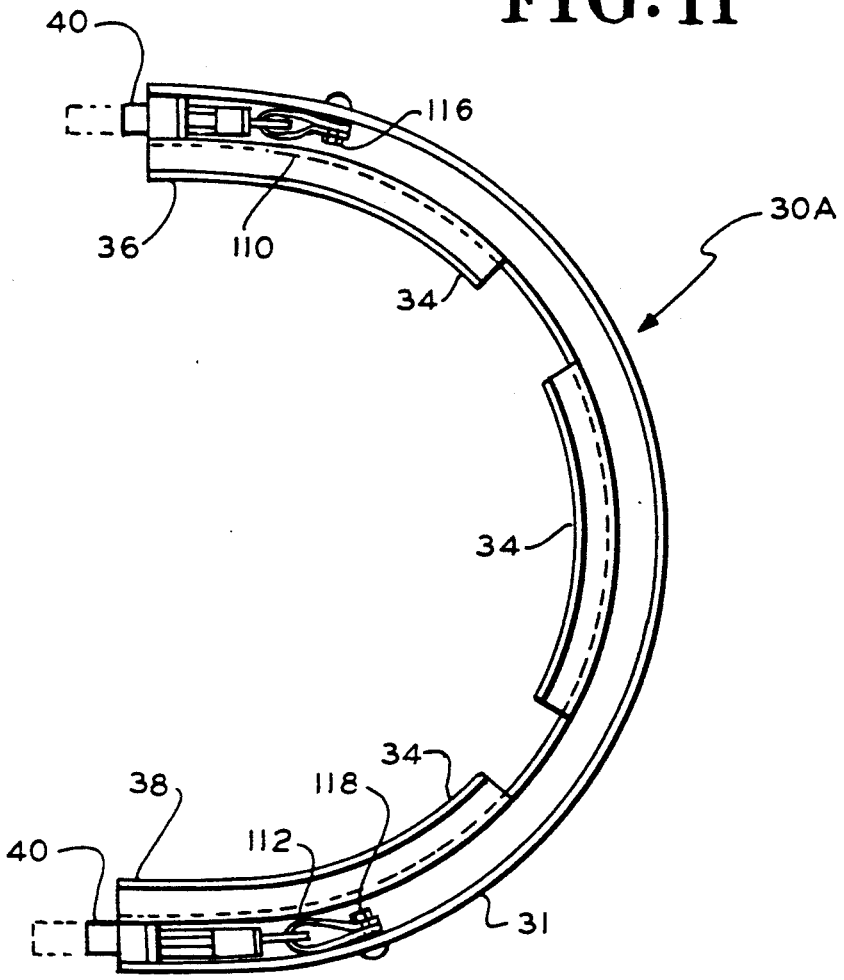
FIGS. 11 and 12 are, respectively, top plan and side views of an alternate embodiment of the mounting member shown in FIGS. 4–6.
Figure 12:
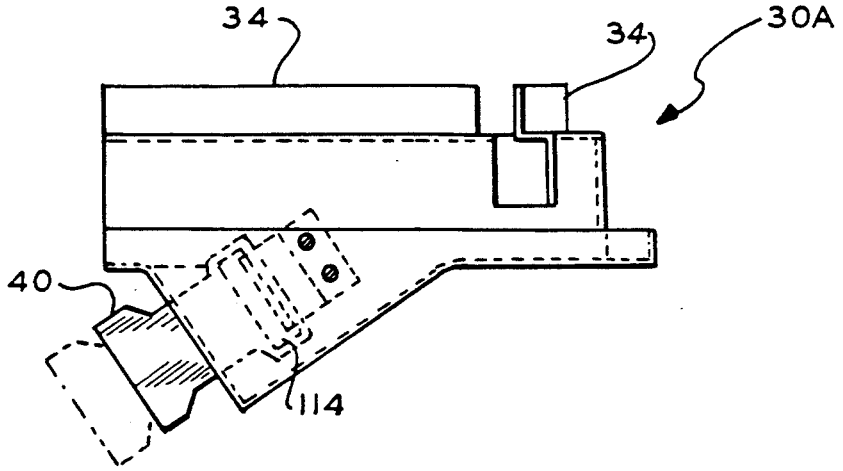

An alternate embodiment of the present invention is shown in FIGS. 11 and 12 and more particularly shown in the FIGS. 11 and 12 is an alternate embodiment 30A of the generally semi-annular mounting member 30 shown in FIGS. 4–6 and described above. For convenience of reference, structural elements shown in FIGS. 11 and 12 which are the same as structural elements shown in FIGS. 4–6 have been given the same numerical designations. Generally it will be understood that in this alternate embodiment tensioning apparatus is provided which includes a pair of resilient straps 110 and 112 for being placed in tension upon the facepiece 12 being placed or forced into sealing engagement with the face 16 of the wearer 18 of the helmet 10. Upon the facepiece 12 being forced into such sealing engagement with the face of the wearer of the helmet by the free ends 100 of the straps 24 being pulled as shown in FIG. 2 and described above, the pair of resilient members 110 and 112 elongate and are placed in tension and the mounting members 40–40 are moved forwardly to occupy the positions therefor shown in dashed outline in FIGS. 11 and 12. The resilient members 110 and 112 upon being placed in such tension maintain, or at least substantially maintain, the force with which the facepiece is forced into sealing engagement with the face of the wearer of the helmet. This provides improved sealing engagement and improved performance of the apparatus of the present invention because, as known to those skilled in the art, upon a protective facepiece being forced into sealing engagement with the face of a wearer of the helmet, such as a firefighter fighting a fire, due to perspiration of the wearer and/or the elevated ambient temperature produced by the fire, the facepiece may become loose or have a tendency towards loosening causing a loss of sealing engagement between the protective facepiece and the wearer. As may be best understood from FIG. 12, the rearward portions of the mounting members 40 are provided with an opening 114 through which the resilient members 110 and 112 are looped with the rearward portions of the resilient members being clamped between the rim 31 of the member 30A and the clamping members indicated respectively by numerical designations 116 and 118 in FIG. 11; such pairs of clamping members are secured to the generally semi-annular mounting member 30A by suitable screws as shown which screw into threaded openings formed in the clamping members. The resilient members or straps 110 and 112 may be made of rubber or of other suitable elastomeric material.

Figure 13:
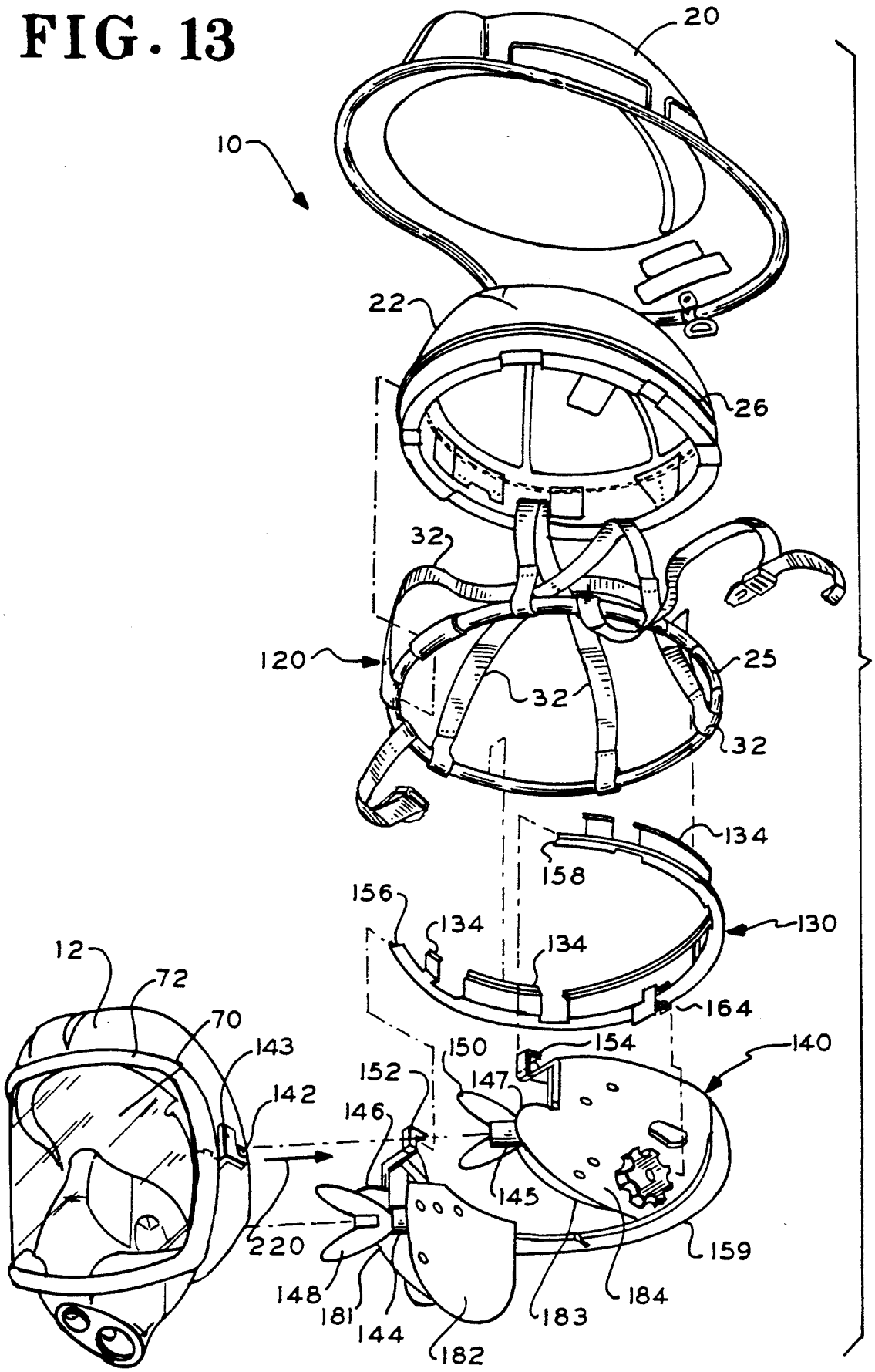
FIG. 13 is an exploded view, in perspective, of a further embodiment of the present invention and which figure includes assembly lines illustrating the manner in which the various structural elements shown in the figure are assembled.

Referring now to FIGS. 13–19, there is shown a further alternate embodiment of protective helmet with protective facepiece connection and adjustment provision for adjusting the force with which the facepiece is forced into sealing engagement with the wearer of the helmet. Referring generally to FIG. 13, the protective helmet 10 shown in FIGS. 1–3 and described above is shown and again indicated by general numerical designation 10. The protective helmet 10 includes a relatively hard or rigid outer shell 20, a deformable inner impact cap or shell 22 mounted removably to the interior of the outer shell 20 as described in the Coombs patent and a cradle of straps indicated by general numerical designation 120 including a plurality of straps 32 for being engaged by the head of the wearer of the helmet. The lower portions of the straps 32 of the cradle of straps 120 encircle the resilient annular tube 25 and the cradle of straps 120 is mounted to the interior of the deformable inner impact cap or shell 22 by the resilient annular tube 25 upon the tube being inserted in the annular groove 26 formed in the lower outer portion of the inner impact cap or shell 22. This embodiment further includes a first generally semi-annular mounting member 130 and a second generally semi-annular mounting member 140. Further generally, it will be understood that the upper portion of the semi-annular mounting member 130 is provided with a plurality of upwardly extending tabs 134 which mount the semi-annular mounting member 130 removably to the inner impact cap or shell 22 upon the tabs 134 being wedged between the resilient annular tube 25 and the lower outer portion of the inner impact cap or shell 22 providing the annular groove 26. Further generally, it will be understood that the second generally semi-annular mounting member 140 is mounted removably to the first generally semi-annular mounting member 130 as shown in detail in FIGS. 14 and 15 and as described in detail below. Further, generally, the facepiece 12 including the transparent lens 70 is provided with a pair of outwardly extending connecting pins 142 for being removably connected to the forward portions of a pair of retaining arms 144 and 145 provided respectively at the forward portions 146 and 147 of the semi-annular mounting member 140; the retaining arms 144 and 145 are shown in their extended positions in FIG. 13. It will be understood that while only one connecting pin 142 is shown in FIG. 13, another connecting pin 142 is provided on the opposite side of the facepiece 12; and it will be further understood that the connecting pins 142 may be provided on suitable clamping brackets 143 which may be clamped to the clamping ring or lens bezel 72 provided on the facepiece 12 in the same manner as clamping bracket 54 shown in FIG. 9 and described above. Still further generally, upon the wearer of the helmet 10 moving the facepiece 12 rightwardly as viewed in FIG. 13 in the direction of the arrow 220, the connecting pins 142 are removably connected to the forward portions of the retaining arms 144 and 145 which arms are mounted retractably in the forward portions 146 and 147 of the semi-annular mounting member 140 with the retaining pins 142 being guided into removable interconnection with the forward portion of the retaining arms 144 and 146 by the generally V-shaped retaining pin guides 148 and 150 mounted on the forward portions of the retaining arms. It will be still further understood that the forward portions 146 and 147 of the semi-annular mounting member 140 are provided with internal ratchet apparatus or mechanisms (not shown in FIG. 13) which operate to maintain the retaining arms 144 and 145 in different retracted or rearward positions as determined by the amount of rightward movement of the facepiece 12 which is determined by the amount of force with which the facepiece 12 is forced into sealing engagement with the facepiece of the wearer of the helmet 10; the ratchet mechanisms are shown in detail in FIGS. 15 and 16 and described in detail below.

Figure 14:
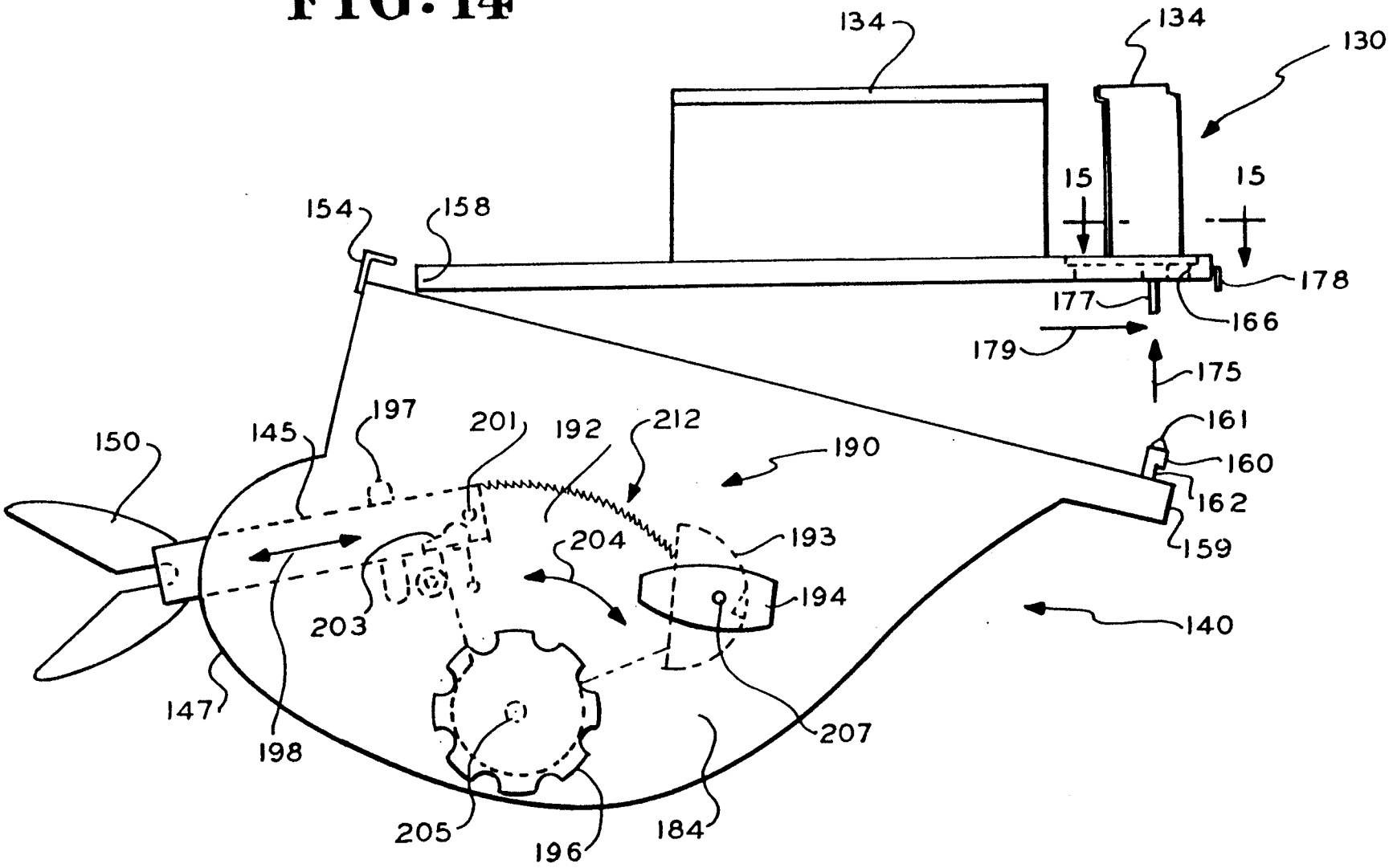
FIG. 14 is a side view of two alternate embodiment mounting members shown in FIG. 13 and illustrating the mounting of one of the mounting members to the other mounting member.
Figure 15:
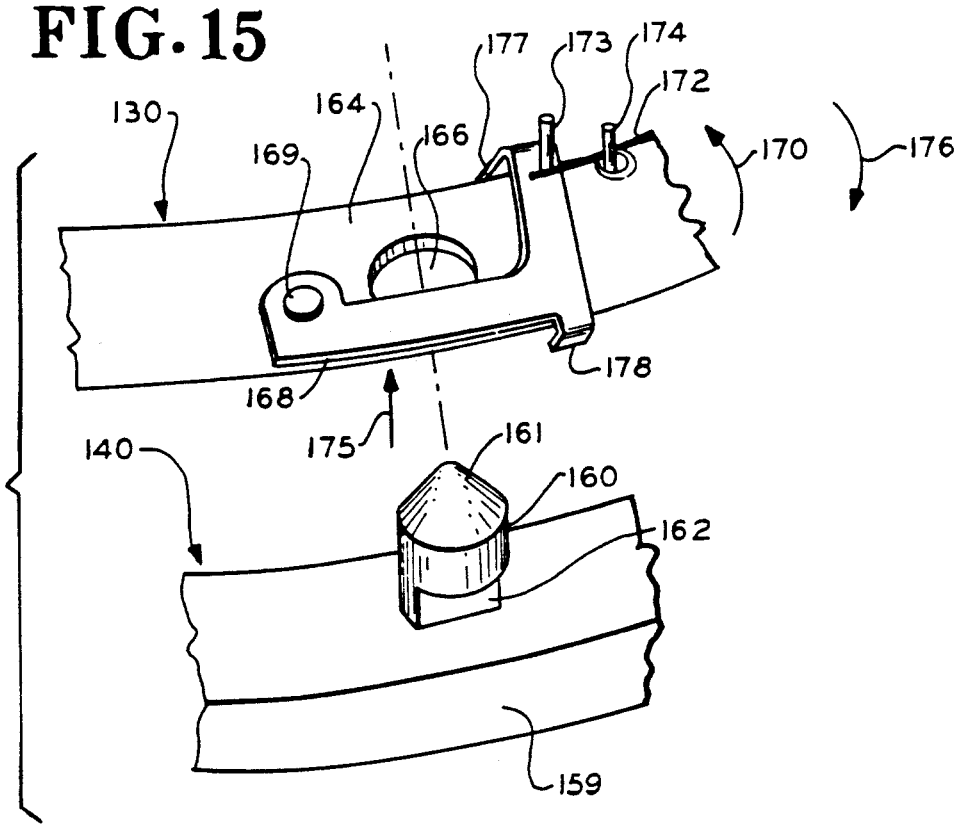
FIG. 15 is an exploded view, in perspective, taken generally along the line 15—15 in FIG. 14 and in the direction of the arrows.

Referring now in detail to the removable mounting of the second generally semi-annular mounting member 140 to the first generally semi-annular mounting member 130, reference is made to FIGS. 13, 14 and 15 and in particular to FIGS. 14 and 15. The upper portions of the forward portions 146 and 147 of the semi-annular mounting member 140, FIG. 13, are provided with a pair of upper and inwardly extending hooks 152 and 154 which, as will be understood from FIG. 14, are latched to the forward portions 156 and 158 (FIG. 13) of the semi-annular mounting member 130. The rearward central portion 159 of the generally semi-annular mounting member 140 (FIGS. 14 and 15) is provided with an upwardly extending retaining pin 160 provided with a conical top 161 and a rearward undercut portion 162. As may be best understood from FIG. 15, the rearward central portion 164 of the mounting member 130 is provided with an opening 166 for receiving the retaining pin 160. A latch bail 168 is mounted pivotally to rearward portions of the the semi-annular mounting member 130 by a pin 169. The latch bail 168 is biased for counterclockwise movement, as viewed in FIG. 15, in the direction of the arrow 170 by the torsion spring 172 engaging the pin 173 extending upwardly from the latch bail 168. The torsion spring 172 is mounted around an upwardly extending pin 174 provided on the member 130 as shown in FIG. 15. Upon the rearward portion of the semi-annular mounting member 140 being moved and forced upwardly in the direction of the arrow 175, FIGS. 14 and 15, the upward conical portion 161 of the retaining pin 160 enters the opening 166 and engages the latch bail 168 forcing the latch bail to pivot clockwise as viewed in FIG. 15, as indicated by the arrow 176, which permits the full cylindrical portion of the retaining pin 160 below the conical point 161 to enter the opening 166 sufficiently far to permit the latch bail 168 to be pivoted counterclockwise by the torsion spring 172, in the direction of the arrow 170 in FIG. 15, and to enter the undercut 162 provided on the retaining pin 160 and removably mount the semi-annular mounting member 140 to the semi-annular mounting member 130 As may be further understood from FIGS. 14 and 15, the latch bail 168 is provided with pivot limiting members 177 and 178. The member 177 also acts as a release member for removal of the semi-annular mounting member 140 from the semi-annular mounting member 130; upon force being applied manually to the member 177 in the direction of the arrow 179 in FIG. 14 the latch bail 168 is pivoted clockwise in the direction of the arrow 176 in FIG. 15 against the action of the torsion spring 172 to release the latch bail from the undercut portion 162 of the retaining pin 160 whereupon the rearward central portion of the semi-annular mounting member 140 may be moved downwardly, opposite to the direction of the arrow 175 in FIG. 15, to remove the semi-annular mounting member 140 from the semi-annular mounting member 130. The force indicated by the arrow 179 in FIG. 14 may be applied manually by the wearer of the helmet 10, FIG. 13.

Figure 16:
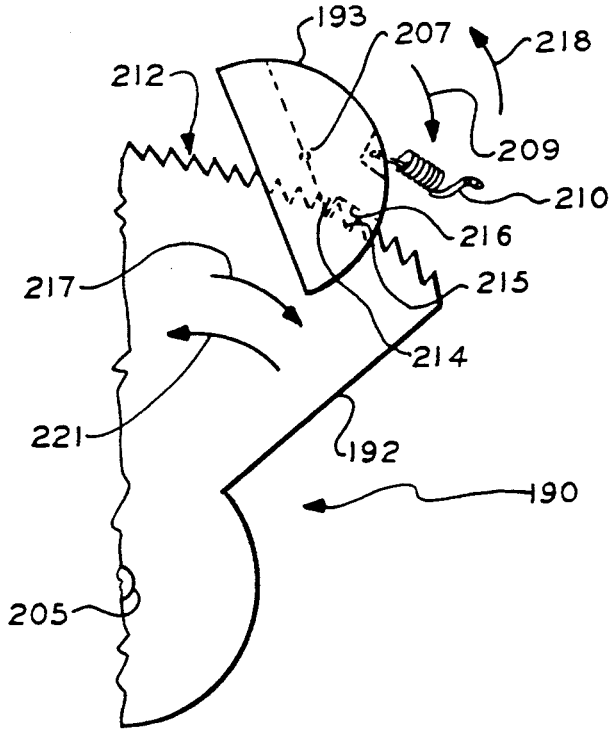
FIG. 16 is a partial view taken from FIG. 14 illustrating a ratchet wheel and pawl and showing in detail the interference engagement between the ratchet wheel teeth and the single tooth of the pawl.

As noted generally above, and referring to FIG. 13, the forward portions 146 and 147 of the generally semi-annular member 140 are provided with internal ratchet mechanisms or apparatus. Although not shown in FIG. 13, it will be understood that such ratchet mechanisms or apparatus are mounted respectively between the outer and inner walls 181 and 182 of the forward portion 146 and the inner and outer walls 183 and 184 of the forward portion 147 of the generally semi-annular mounting member 140. In FIGS. 14 and 16, only the ratchet mechanism or apparatus mounted between the inner and outer walls 183 and 184 of the forward portion 147 of the generally semi-annular mounting member 140 is shown, although it will be understood that the same ratchet mechanism or apparatus is mounted between the outer and inner walls 181 and 182 of the forward portion 146 of the generally semi-annular mounting member 140. Referring specifically to FIGS. 14 and 16 and in particular FIG. 14, the ratchet mechanism or apparatus is indicated by general numerical designation 190 and includes the retaining arm 145, a ratchet sector or wheel 192, a pawl 193, a pawl release member 194 and a hand wheel 196; a generally V-shaped connecting pin guide 150 is mounted to the forward portion of the retaining arm 145. Retaining arm 145 is mounted for generally linear reciprocal movement, as indicated by the double headed arrow 198 in FIG. 14, by the mounting member 197 which mounting member it will be understood and although not shown is generally U-shaped in transverse cross-section. The rearward portion of the retaining arm 145 is mounted pivotally to the ratchet wheel 192 by pin 201 and the ratchet wheel 192 is mounted for reciprocal rotational motion in the clockwise and counterclockwise directions, as indicated by the double-headed arrow 203 in FIG. 14, by being secured to a pin 205 which is suitably mounted for rotation between the inner and outer walls 183 and 184 of the forward portion 147 of the generally semi-annular mounting member 140. The ratchet wheel 192 is spring biased into a leftward or counterclockwise portion, as viewed in FIG. 14, by the torsion spring 203, and as will be generally understood, the ratchet wheel 192 is rotatable into a plurality of different rightward or clockwise positions in response to different amounts of rightward movement of the retaining arm 145; the pawl 193 maintains the ratchet wheel 192 in different rightward or clockwise positions. Also (FIG. 14) secured to the rotatable pin 205 for rotation therewith, and with the ratchet wheel 192, is a hand wheel 196. The pawl 193 and the release member 194 are fixedly secured to the pin 207 which is mounted for suitable rotation between the inner and outer walls 183 and 184 of the forward portion 147 of the generally semi-annular mounting member 140.

The pawl 193, FIG. 16, is biased for clockwise rotation in the direction of the arrow 209 by the tension spring 210. The upper arcuate portion of the ratchet wheel 192, FIG. 16, is provided with a plurality of upwardly extending ratchet wheel teeth indicated by general numerical designation 212. It will be understood from FIG. 16 that the leftward edges of the ratchet wheel teeth 212 are substantially vertical and that the rightward edges of the ratchet wheel teeth are sloped. It will be further understood from FIG. 16 that the pawl 193 is provided with a single downwardly extending pawl tooth 214 for interference engagement with the ratchet wheel teeth 212, the pawl tooth 214 is provided with the reverse vertical and sloped edges of the ratchet wheel teeth 212 Further, FIG. 16, the pawl 193 is provided with a flat portion 216.

It will be assumed that the connecting pins 142 provided on the opposite sides of the protective facepiece 12, FIG. 13, have been removably connected to the forward portions of the retaining arms 144 and 145, which removable interconnection is described in detail below and illustrated in FIGS. 17-19, and that the wearer of the helmet 10 is moving the facepiece 12 rightward in the direction of the arrow 220 in FIG. 12 to place or force the facepiece into sealing engagement with the wearer's face. Referring now only to retaining arm 145 shown in FIGS. 14 and 16, such rightward movement of the retaining arm 145 will impart clockwise rotation to the ratchet wheel 192 being rotated in the clockwise direction as indicated by the arrow 217 in FIG. 16, the sloped rightward edges of the ratchet wheel teeth 212 will engage the single pawl tooth 214 and cause the pawl 193 to rotate in the counterclockwise direction as indicated by the arrow 218 against the influence of the tension spring 210 and such rotation relieves the interference between the pawl tooth 214 and the ratchet wheel teeth 212. Upon the ratchet wheel 192 being rotated into a rightward or clockwise position as determined by the rightward movement of the retaining arm 145 as described above, the torsion spring 203 (FIG. 14) will tend to rotate, and will slightly rotate, the ratchet wheel 192 in the counterclockwise direction as indicated by the arrow 221 in FIG. 16 whereupon the leftward vertical edge of the ratchet wheel tooth 215 will engage the vertical edge of the single pawl tooth 214 causing the pawl to rotate in the clockwise direction as indicated by the arrow 209 in FIG. 16 until the pawl flat 216 engages the ratchet wheel teeth 212 residing underneath the flat 216. When the pawl flat 216 engages the ratchet wheel teeth 212 residing underneath the flat, the clockwise rotation of the pawl 193 will be stopped or arrested and the single pawl tooth 214 engaging the leftward vertical edge of the ratchet wheel tooth 215 will stop or halt the counterclockwise rotation of the ratchet wheel 192 and the ratchet wheel 192 will be locked or maintained in a rightward or clockwise position as viewed in FIGS. 14 and 16. The force with which the facepiece 12 is forced into sealing engagement with the face of the wearer of the helmet 10 may be adjusted, namely increased, by the wearer rotating the hand wheel 196 in the clockwise direction as indicated by the arrow 217 in FIG. 16 whereupon the interference between the single pawl tooth 214 and the ratchet wheel teeth 212 will be relieved as described above, and upon the desired increased sealing force being achieved, the wearer of the helmet 10 (FIG. 13) releases the hand wheel 196 and the above-described interference engagement between the pawl tooth 214 and the pawl flat 216 with the ratchet wheel teeth 212 is again established and the ratchet wheel 192 will be locked or maintained in a different right or clockwise position as viewed in FIGS. 14 and 16.

Figure 17:
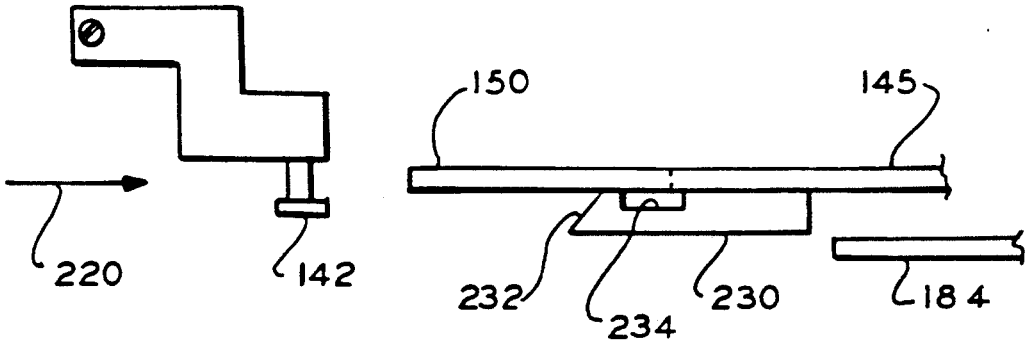
FIGS. 17, 18 and 19 are partial top views illustrating in sequence the removable interconnection of a connecting pin provided on a protective facepiece with the forward portion of a retaining arm.
Figure 18:
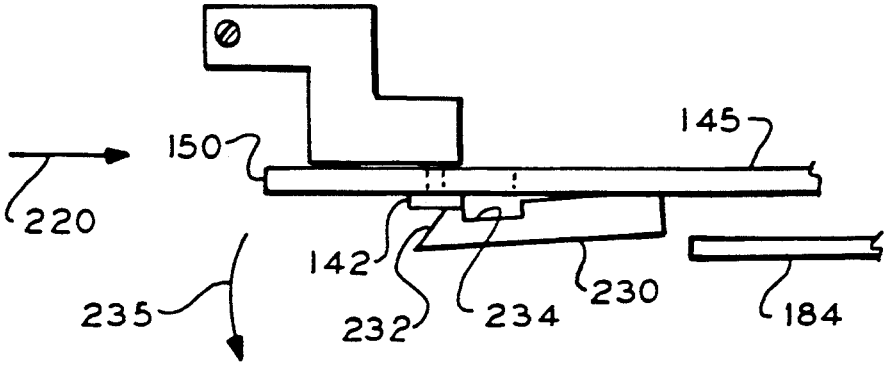
Figure 19:
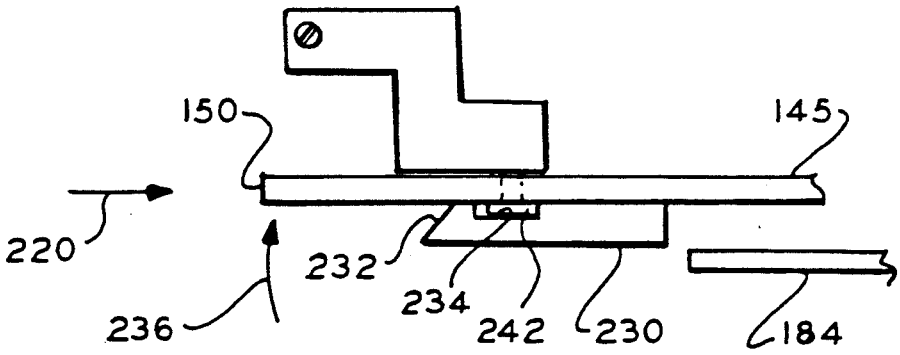

The removable interconnections between the retaining pins 142, FIG. 13, provided on opposed sides of the facemask 12, and the forward portions of the retaining arms 144 and 145 is illustrated sequentially in FIGS. 17-19 with regard to retaining arm 145. The retaining arm 145 is provided with a latch member 230whose rightward or rearward portion is suitably secured to the retaining arm 145 to cause the latch member to act as a leaf spring or in cantilever fashion as shown particularly in FIG. 18. The leftward or forward portion of the latch member 230 is provided with an inwardly sloped surface 232 which acts as a cam or camming surface. Further, the latch member 230 is provided with a notch or slot 234 for receiving the enlarged head of the connecting pin 142. Upon the wearer of the helmet 10, FIG. 13, manually moving the facepiece 12 rightwardly as indicated by the arrow 220 in FIGS. 13 and 17-19, the facepiece connecting pin 142 enters the V-shaped retaining pin guide 150. Upon continued rightward movement of the connecting pin in the direction of the arrow 220, and referring now to FIG. 18, the enlarged head of the connecting pin 142 engages the sloped or camming surface 232 of the latch member 230 and cams or pivots the leftward or forward portion of the latch member 230 away from the retaining arm 145, in the direction of the arrow 235, which, as shown in FIG. 19, permits the enlarged head of the connecting pin to enter the notch or slot 234 upon further rightward movement of the connecting pin 142. Upon entry of the enlarged head of the connecting pin 242 into the notch or slot 234 (FIG. 19), the latch member 230, due to its above-described cantilever or leaf spring mounting, pivots upwardly in the direction of the arrow 236 and the enlarged head of the connecting pin 244 is captured between the latch member 230 and the forward portion of the retaining arm 145 and, the connecting pin 142 and hence the facepiece 12 (FIG. 13) is removably connected to the forward portion of the retaining arm 145. It will be further understood from FIG. 19 that in the further process of placing the facemask 12 (FIG. 13) into sealing engagement with the facepiece of the wearer of the helmet 10 (FIG. 13), the facepiece 12, connecting pin 142 and the retaining arm 144 will be moved further rightwardly in the direction of the arrow 220 in FIG. 19, and the latch member 230 will reside between the retaining arm 145 and the outer wall 184 (FIGS. 13 and 19) of the forward portion 147 of the generally semi-annular mounting member 140, and the latch member 230 will be prevented from being pivoted outwardly in the direction indicated by the arrow 235 in FIG. 18 and the enlarged head of the connecting pin 242 will remain captured between the latch member 230 and the forward portion of the retaining arm 145.

Removal of the facepiece 12, FIG. 13, from sealing engagement with the face of the wearer of the helmet 10 will now be described with reference only to the ratchet mechanism 190 shown in FIGS. 14 and 16, but it will be understood that such removal operation is occurring with regard to the ratchet mechanism mounted on the opposite side of the semi-annular mounting member 140. Such removal is accomplished by the wearer rotating the pawl release member 194 counterclockwise as viewed in FIG. 14 which counterclockwise rotation relieves the interference engagement between the pawl tooth 214 and the ratchet wheel teeth 212, FIG. 16, which permits the torsion springs 203, FIG. 14, to rotate the ratchet wheel 292 counterclockwise as viewed in in FIG. 14, until the ratchet wheel 192 resumes its leftward or counterclockwise position shown in FIG. 14. Such counterclockwise rotation of the ratchet wheel 192 moves the connecting arm 145 leftwardly whereupon the retaining arm 145 again assumes its leftward position shown in FIGS. 14 and 19. Then, with regard to the forward portion of connecting arm 145 shown in FIGS. 17-19, the wearer of the helmet 10 may manually pivot the forward portion of the latch member 230, in the direction of the arrow 235 in FIG. 18, away from the forward portion of the retaining arm 145 to permit the enlarged head of the connecting pin 142 to be moved leftwardly, in the direction opposite to that indicated by the arrow 220 in FIG. 18, whereupon the enlarged head of the connecting pin 142 will be freed from the latch member 230 and forward portion of the retaining arm 145 and the connecting pin 142 and hence the facepiece 12 will be disconnected from the forward portion of the retaining arm 145.

It will be understood by those skilled in the art that many modifications and variations may be made in the present invention without departing from the spirit and the scope thereof.

What is claimed is:

1. In combination, comprising:

a protective helmet including an outer shell and a separate deformable inner impact shell mounted removably to the interior of said outer shell;

a protective facepiece; and mounting means for mounting said facepiece removably to said separate deformable inner impact shell, and operable by the wearer of said helmet to force said facepiece into sealing engagement with the face of said wearer of said helmet; said mounting means are adjustable mounting means operable by said wearer to adjust the force with which said facepiece is forced into sealing engagement with the face of said wearer of said helmet; said protective helmet further includes a cradle of straps of webbing for engaging said head of said wearer of said helmet; and wherein said adjustable mounting means include:

(i) first mounting means for mounting said cradle of straps of webbing removably to said inner impact shell and internally thereof, (ii) second mounting means mounted removably to said inner impact shell by said first mounting means, and (iii) adjustable interconnecting means for interconnecting said facepiece to said second mounting means operable by said wearer to force said facepiece into sealing engagement with the face of said wearer with adjustable force.

2. The combination of claim 1 wherein said first mounting means comprise a groove provided in said inner impact shell and a resilient member residing in said groove, and wherein said second mounting means comprise a generally semi-annular mounting member provided with an upwardly extending portion for being wedged between said resilient member and said inner impact shell to removably mount said generally semi-annular mounting member to said inner impact shell.

3. The combination according to claim 2 wherein said inner impact shell includes a generally semi-annular lower rearward portion, wherein said generally semi-annular mounting member is generally complementary in shape to said generally semi-annular lower rearward portion of said inner impact shell and wherein said generally semi-annular mounting member also includes a pair of forward portions, wherein said generally semi-annular mounting member is provided with a plurality of upwardly extending portions for being wedged between said resilient member and said inner impact shell to removably mount said generally semi-annular mounting member to and generally underlying said generally semi-annular rearward portion of said inner impact shell, wherein said forward portions of said generally semi-annular mounting member are provided respectively with third and fourth mounting means, wherein said interconnecting means comprise a pair of interconnecting members having forward and rearward portions, said forward portions of said pair of interconnecting members provided respectively with fifth and sixth mounting means for removably mounting said pair of interconnecting members to said protective facepiece and wherein said rearward portions of said pair of interconnecting members are provided respectively with seventh and eighth mounting means for removably mounting said rearward portions of said pair of interconnecting members to said third and fourth mounting means provided on said forward portions of said generally semi-annular mounting member.

4. The combination according to claim 3 wherein said adjustable means comprise a pair of adjustable members each provided on one of said interconnecting members and for adjusting the force with which one of said interconnecting members forces said facepiece into sealing engagement with said face of said wearer of said helmet.

5. The combination according to claim 4 wherein said facepiece includes an outer flexible body having a generally central opening formed therein, a transparent lens and a clamp ring for clamping said lens to said flexible body:

wherein each of said interconnecting members comprise a flexible strap having forward and rearward portions, said forward portion including a free end;

wherein each of said fifth and sixth mounting means provided on said forward portions of said interconnecting members includes: (i) a clamping bracket for being clamped to said clamp ring on one side of said facepiece, each clamp provided with an outwardly extending headed connecting pin including a shank and an enlarged head provided at the end of said shank, (ii) a keyed connector plate of resilient material having a keyway opening formed therein including a first open portion sufficiently large to permit the insertion therethrough of said enlarged head, a channel portion defined by two opposed flexible members spaced apart a sufficient distance to permit the forced passage therethrough of said shank, and a second open portion smaller than said enlarged head for receiving and capturing said head upon said shank being forced through said channel portion to thereby removably mount said keyed connector plate to said clamping bracket, (iii) buckle comprising one of said adjustble members and including a rearward portion and a pair of transverse bars one of which is for having said forward portion of one of said flexible straps wrapped therearound and said bars adjusting the force with which said facepiece is forced into sealing engagement with the face of said wearer of said helmet by decreasing the effective length of said flexible strap upon the free end of said forward portion of said flexible strap being pulled forward of said face of said helmet wearer whereby said facepiece is placed in a user position on said face of said helmet wearer, (iv)a mounting plate for engaging said rearward portion of said buckle and for mounting said buckle to said keyed connector plate, and (v) fastening means for mounting said clamping plate to said keyed connector plate;

wherein said third and fourth mounting means mounted respectively on said forward portions of said generally semi-annular member each comprise a receptacle member including a plurality of locking slots and wherein said seventh and eighth mounting means mounted respectively on said rearward portions of said pair of connecting members comprise a clasp member including a plurality of resilient arms having locking tabs thereon for releasably engaging said locking slots of said receptacle member to removably mount said rearward portions of said interconnecting members, and thereby said facepiece, to said generally semi-annular mounting member; and wherein upon each of said buckle being pivoted away from said face of said helmet wearer the effective length of said flexible straps being increased to relieve said force with which said facepiece is forced into sealing engagement with said face of said helmet wearer to permit said facepiece to be placed in a a standby position.

6. The combination according to claim 1 wherein said adjustable interconnecting means include resilient means for being placed in tension upon said facepiece being forced into said sealing engagement with said face of said wearer of said helmet and said resilient means for substantially maintaining the force with which said facepiece is forced into said sealing engagement with said face of said wearer of said helmet.

7. The combination according to claim 1 wherein said adjustable interconnecting means include resilient means for being placed in tension upon said facepiece being forced into said sealing engagement with said face of said wearer of said helmet and said resilient means for substantially maintaining the force with which said facepiece is forced into said sealing engagement with said face of said wearer of said helmet.

8. The combination according to claim 7 wherein said second mounting means are provided with a first pair of mounting members, wherein said interconnecting means are provided with a second pair of mounting members for interconnecting with said first pair of mounting members, and wherein said resilient means comprise a pair of resilient straps having rearward and forward portions, said rearward portions of said straps are connected to said second mounting means and said forward portions of said straps are connected to said second pair of mounting members.

9. The combination according to claim 1 wherein said mounting means include ratchet means operable by said wearer to force said facepiece into said sealing engagement with said face of said wearer of said helmet.

10. The combination according to claim 1 wherein said adjustable mounting means include ratchet means operable by said wearer to adjust the force with which said facepiece is forced into said sealing engagement with said face of said wearer of said helmet.

11. The combination according to claim 1 wherein said adjustable interconnecting means include ratchet means operable by said wearer to force said facepiece into said sealing engagement with said face of said wearer with adjustable force.

12. The combination according to claim 1 wherein said second mounting means comprise first and second generally semi-annular mounting members, said first generally semi-annular mounting member for being mounted removably to said inner impact shell by said first mounting means, said second generally semi-annular mounting member for being mounted removably to said first generally semi-annular mounting member, wherein said facepiece includes opposite side portions provided with outwarding extending connecting pins, wherein said second generally semi-annular mounting member includes generally opposed side portions, wherein said adjustable interconnecting means comprise a pair of combination retaining arm, ratchet wheel and pawl with each combination being mounted on one of said generally opposed side portions of said second generally semi-annular mounting member, said retaining arms mounted for generally reciprocal linear movement between an extended position and a plurality of retracted positions, said ratchet wheels and said pawls mounted for reciprocal rotatable movement and said ratchet wheels and said pawls spring biased toward first positions and said ratchet wheels rotatable into a plurality of second positions in response to different amounts of linear movement of said retaining arms from said extended position into one of said plurality of retracted positions and said pawls engagable with said ratchet wheels to maintain said ratchet wheels in said second positions, a pair of hand wheels each connected to one of said ratchet wheels and for rotating said ratchet wheels into different ones of said second positions, said retaining arms including forward and rearward portions, said rearward portions of said retaining arms mounted pivotally to said ratchet wheels, and said forward portions of said retaining arms provided with connecting members for being removably connected to said connecting pins provided on said facepiece, upon said retaining arms being in said extended positions and upon said wearer of said helmet connecting said connecting pins provided on said facepiece to said connecting members provided on said forward portion of said retaining arms and upon said wearer moving said retaining arms into one of said retracted positions said facepiece being forced into said sealing engagement with said face of said wearer and said ratchet wheels being rotated from said first positions into one of said plurality of second positions and said pawls engaging said ratchet wheels to maintain said ratchet wheels in said one of said second positions to maintain said force with which said facepiece is forced into engagement with said face of said wearer, and upon said hand wheels being rotated to rotate said ratchet wheels into another of said second positions said force with which said facepiece is forced into engagement with said face of said wearer of said helmet being adjusted, said pawls provided with pawl release members and upon said pawl release members eing operated by said wearer of said helmets said pawls being disengaged from said ratchet wheels whereupon said ratchet wheels are returned to said first position and said retaining arms are moved into said extended position whereby said wearer of said helmet may disconnect said connecting pins provided on said facepiece from said connecting members provided on said forward portion of said retaining arms.

* * * * *